US005232060A

United States Patent [19]

Evans

[11] Patent Number: 5,232,060

[45] Date of Patent: Aug. 3, 1993

[54] DOUBLE-ACTING ACCELERATOR FOR USE WITH HYDRAULIC DRILLING JARS

[76] Inventor: Robert W. Evans, 12986 Wood Harbor, Montgomery, Tex. 77356

[21] Appl. No.: 745,416

[22] Filed: Aug. 15, 1991

[51] Int. Cl.[5] ..... E21B 4/14

[52] U.S. Cl. ..... 175/297; 166/178

[58] Field of Search ..... 175/296, 297, 299; 166/178

[56] References Cited

U.S. PATENT DOCUMENTS

| | | | |
|---|---|---|---|
| 4,109,736 | 8/1978 | Webb et al. | 175/297 |
| 4,361,195 | 11/1982 | Evans | 175/299 X |
| 5,086,853 | 2/1992 | Evans | 175/297 |

*Primary Examiner*—David J. Bagnell

*Attorney, Agent, or Firm*—Arnold, White & Durkee

[57] ABSTRACT

A double acting accelerator 1 includes a mandrel 2 arranged in a housing 3 for sliding longitudinal movement. A pair of pistons 89, 111 are positioned radially between the housing 3 and mandrel 2 to form a substantially sealed chamber 88 longitudinally therebetween. Movement of the mandrel 2 in a first direction urges the first piston 89 toward the second piston 111, thereby greatly increasing the pressure of fluid in the chamber 88. Movement of the mandrel 2 in a second, opposite direction urges the second piston 111 toward the first piston 89 to, likewise, greatly increase the pressure of fluid in the chamber 88. Thus, a large amount of energy is stored in the accelerator 1 independent of the relative direction of movement of the mandrel 2 and housing 3.

15 Claims, 3 Drawing Sheets

DOUBLE-ACTING ACCELERATOR FOR USE WITH HYDRAULIC DRILLING JARS

BACKGROUND OF THE INVENTION

1. Technical Field

This invention relates to an accelerator for use with hydraulic jars in a drilling environment and, in particular, to a double acting accelerator for use with double acting hydraulic jars.

2. Description of the Related Art

Drilling jars have long been known in the field of well drilling equipment. A drilling jar is a tool employed when either drilling or production equipment has become stuck to such a degree that it cannot be readily dislodged from the wellbore. The drilling jar is normally placed in the drill string in the region of the stuck object and allows an operator at the surface to deliver a series of impact blows to the drill string via a manipulation of the drill string, such as by lowering and raising the drill string. Hopefully, these impact blows to the drill string are sufficient to dislodge the stuck object and permit continued operation.

Drilling jars contain a sliding joint which allows relative axial movement between an inner mandrel and an outer housing without allowing rotational movement therebetween. The mandrel typically has a hammer formed thereon, while the housing includes an anvil positioned adjacent the mandrel hammer. Thus, by sliding the hammer and anvil together at high velocity, they transmit a very substantial impact to the stuck drill string, which is often sufficient to jar the drill string free.

In some instances it is desirable to greatly enhance the force of the impact blows so that a much larger hammering force can be applied to a stuck object. Typically, the force of the drilling jar has been enhanced by adding an accelerator to the drill string. The accelerator is used to store energy until the jar is triggered. When the jar is triggered, the accelerator quickly releases its stored energy and accelerates the hammer of the drilling jar to a very high speed. The force of the impact is, of course, related to the square of the velocity, thus, the hammer force is greatly enhanced by the accelerator.

Recently, drilling jars have been developed that are capable of delivering hammer blows in both an upward and downward direction. For example, U.S. Pat. No. 4,361,195, issued November 30, 1982, to Robert W. Evans, describes such a double acting drilling jar.

Heretofore, double acting accelerators have not been available to cooperate with double acting drilling jars. Thus, it has not been possible to deliver enhanced upward and downward hammer blows with these double acting drilling jars.

The present invention is directed to overcoming or minimizing one or more of the problems discussed above.

SUMMARY OF THE INVENTION

In one aspect of the present invention, a double acting accelerator is provided. The accelerator includes a tubular housing, and a tubular mandrel substantially coaxially arranged for telescoping longitudinal movement within the tubular housing. A first piston is positioned radially between the tubular housing and mandrel, and is adapted for movement with the mandrel in response to movement of the mandrel in a first longitudinal direction relative to the housing. Further, the first piston is also adapted to resist longitudinal movement in response to movement of the mandrel in a second longitudinal direction relative to the housing. A second piston is positioned radially between the tubular housing and mandrel, and with the first piston forms a substantially sealed chamber therebetween. The second piston is adapted for movement with the mandrel in response to movement of the mandrel in the second longitudinal direction relative to the housing and adapted to resist longitudinal movement in response to movement of the mandrel in the first longitudinal direction relative to the housing. Thus, the chamber has an increase in pressure in response to movement of the mandrel in both the first and second longitudinal directions relative to the housing.

BRIEF DESCRIPTION OF THE DRAWINGS

Other objects and advantages of the invention will become apparent upon reading the following detailed description and upon reference to the drawings in which.

Figure 1A:
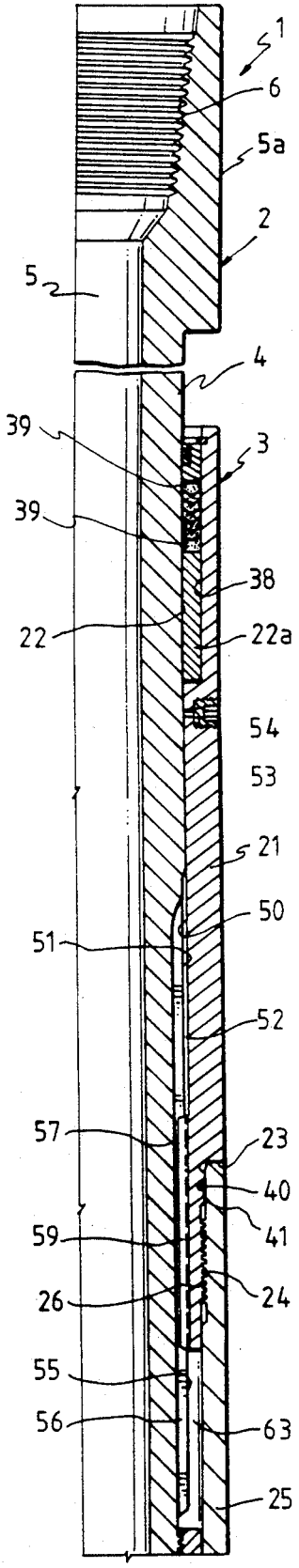
FIGS. 1A–C illustrate successive portions, in quarter section, of a double acting accelerator located in its neutral operating position.

While the invention is susceptible to various modifications and alternative forms, specific embodiments thereof have been shown by way of example in the drawings and will herein be described in detail. It should be understood, however, that this specification is not intended to limit the invention to the particular forms disclosed herein, but on the contrary, the intention is to cover all modifications, equivalents, and alternatives falling within the spirit and scope of the invention, as defined by the appended claims.

DESCRIPTION OF A PREFERRED EMBODIMENT

Figure 1B:
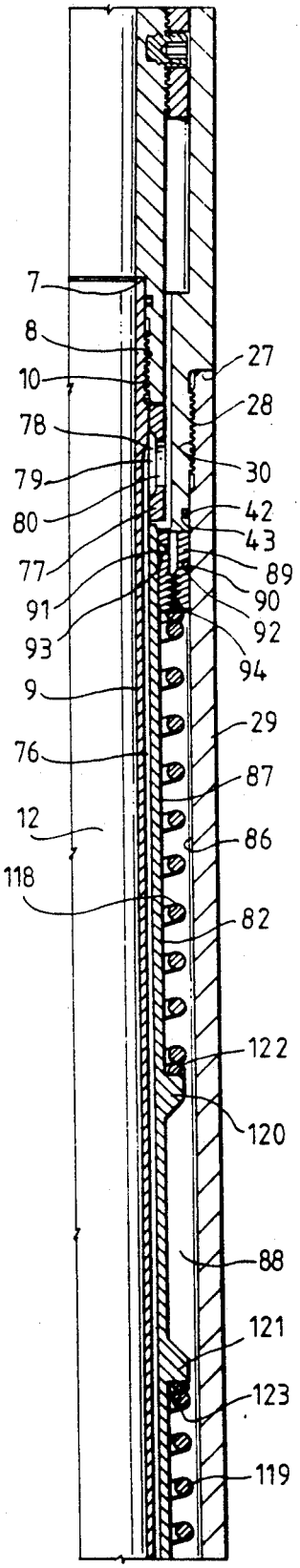
Figure 1C:
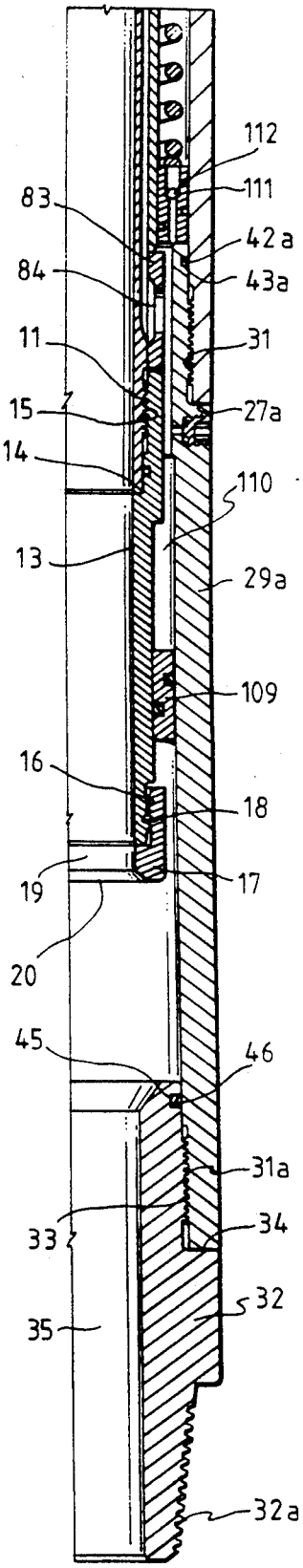

Referring to the drawings, and in particular, to FIGS. 1A–C, inclusive, there is shown a double acting accelerator 1, which is of substantial length necessitating that it be shown in three longitudinally broken quarter sectional views, viz. FIGS. 1A, 1B, and 1C. Each of these views is shown in longitudinal section extending from the center line (represented by a dashed line) of the accelerator 1 to the outer periphery thereof. The accelerator 1 generally comprises an inner tubular mandrel 2 telescopingly supported inside an outer tubular housing 3. The mandrel 2 and housing 3 each consists of a plurality of tubular segments joined together preferably by threaded interconnections.

The mandrel 2 consists of an upper tubular portion 4 having an inner longitudinal passage 5 extending therethrough. The upper end of the upper tubular portion 4 is enlarged as indicated at **5*a* and is internally threaded at 6 for connection to a conventional drill string or the like (not shown). The lower end of the upper tubular portion 4 is provided with a counterbore ending in an internal shoulder 7 and is internally threaded as indicated at 8. An intermediate portion of the mandrel 2 consists of a tubular portion 9 which has its upper end threaded as indicated at 10 for connection inside the threaded portion 8 of the upper tubular portion 4 with the upper end portion abutting the shoulder 7. The lower end of the tubular portion is threaded externally as indicated at 1 and is provided with an internal bore or passage 12, which is a continuation of the passage 5 in the upper tubular portion 4. The lower end of the mandrel 2 consists of a tubular portion 13, which is provided with a counterbore ending in a shoulder 14 and internally threaded as indicated at 15. The tubular portion 13 is threadedly assembled to the lower end of the tubular portion 9, with the lower end thereof abutting the shoulder 14**.

The lower end portion of the tubular portion 13 is threaded as indicated at 16. A sleeve member 17 having internal threads 18 is threadedly secured on the lower end of the tubular portion 13. The tubular portion 13 is provided with an internal longitudinal passage 19 which is an extension of the passages 5, 12 and opens through a central opening 20 of the sleeve member 17. The three portions 4, 9, 13 of the mandrel 2, are threadedly assembled, as shown, into the unitary tubular mandrel 2, which is longitudinally movable inside the tubular housing 3.

The tubular housing 3 is formed in several sections for purposes of assembly, somewhat similar to the mandrel 2. The upper end of the tubular housing 3 consists of a tubular member 21 which has a smooth inner bore 22 formed by a conventional bearing **22*a* at its upper end in which the exterior surface of the upper mandrel tubular portion 4 is positioned for longitudinal, sliding movement. The lower end portion of the tubular housing member 21 has a portion of reduced diameter forming an annular shoulder 23 and having an exterior threaded portion 24**.

The tubular housing 3 is provided with an intermediate tubular member 25 which is internally threaded as indicated at 26 at its upper end for threaded connection to the threaded portion 24 of the tubular member 21. The upper end of the intermediate tubular member 25 abuts the shoulder 23 when the threaded connection is securely tightened. The lower end portion of the tubular member 25 has a portion of reduced diameter forming a shoulder 27 and is externally threaded, as indicated at 28.

The lower portion of the tubular housing 3 consists o a tubular member 29 which is internally threaded, as indicated at 30, at its upper end for connection to the threaded portion 28 of the intermediate tubular member 25. The upper end of the lower tubular member 29 abuts the shoulder 27 when the threaded connection is securely tightened. The lower end of the tubular member 29 is internally threaded, as indicated at 31.

A tubular member **29*a* has a portion of reduced diameter forming a shoulder 27*a* and is threadedly connected at its upper end to the threaded portion 31 of the tubular member 29 in abutting relation with the shoulder 27*a*. The lower end of the tubular member 29*a* includes a threaded portion 31*a* engageable with a tubular connecting member 32. The tubular connecting member 32 is externally threaded, as indicated at 33, at its upper end and has a shoulder 34 against which the lower end of the tubular member 29*a* abuts when the threaded connection 31*a*, 33 is securely tightened. The tubular connecting member 32 has an inner longitudinal passage 35 which is a continuation of the passages 5, 12, 19 through the mandrel 2. The lower end of the tubular connecting member 32 is of a reduced diameter and is provided with an externally threaded surface 32*a*** for connection into the lower portion of a drill string or for connection to a fish, or the like (not shown), when the apparatus is used with a fishing jar.

As has already been noted, the mandrel 2 and housing 3 are formed in sections for purposes of assembly. The mandrel 2 is arranged for sliding movement inside housing 3. A chamber formed between the mandrel 2 and housing 3 is filled with a suitable operating fluid that is preferably compressible, e.g. silicone, and it is therefore necessary to provide seals against leakage from threaded joints formed at the various sections of the mandrel 2 and housing 3 and also from the points of sliding engagement between the mandrel 2 and housing 3.

As previously noted, the exterior surface of the upper mandrel portion 4 has a sliding fit in the bore 22 of the upper tubular member 21 of the housing 3. The tubular member 21 is provided with at least one internal annular recess 38 in which there is positioned at least one seal 39, which seals the sliding joint against leakage of hydraulic fluid. Likewise, the threaded connection between the tubular housing members 21, 25 is sealed against leakage by an O-ring 40, or the like, positioned in an external peripheral groove 41 in the lower end of the tubular housing member 21. The threaded connection between the tubular housing members 25, 29 is similarly sealed against fluid leakage by an O-ring 42 positioned in a peripheral groove 43 in the lower end portion of the tubular housing member 25. Likewise, the threaded connection between the tubular housing members 29, **29*a* is sealed against fluid leakage by an O-ring 42*a* positioned in a peripheral groove 43*a* in the upper end portion of the tubular housing member 29*a***.

Finally, the threaded connection between the lower end of the tubular housing member **29*a* and the connecting member 32 is similarly sealed against leakage of fluid by an O-ring 46 positioned in an peripheral groove 45 in the upper end of the connecting member 32. Similar seals ar provided to prevent leakage through the threaded joints connecting the several sections of the mandrel 2**.

The space between the inner bore of the various components of the housing 3 and the external surface of the mandrel 2 provides an enclosed chamber and passages for the flow of operating fluid, such as silicone, throughout the accelerator.

At the upper end of the tubular housing member 21, the space between an inner bore 50 thereof and an external surface 51 of the tubular mandrel portion 4 provides a chamber 52. The upper end of the chamber 52 is provided with a threaded opening 53 in which a threaded plug member 54 is secured. The threaded opening 53 provides for the introduction of the operating fluid.

The exterior surface of the tubular mandrel portion 4 is of slightly reduced diameter at a lower end portion 55 thereof, and is provided with a plurality of longitudinally extending grooves 56 forming splines therebetween. The lower end portion of the tubular housing member 21 is provided with an inner bore 57 having a plurality of longitudinally extending grooves 59 therein and circumferentially spaced to define a plurality of splines therebetween to interact with the splines and grooves 56 in the upper tubular mandrel portion 4. The grooves 56, 59 in the tubular housing member 21 and in the tubular mandrel portion 4 are of greater depth than the height of the opposed splines positioned in those grooves 56, 59. As a result, longitudinal passages are provided along the respective grooves 56, 59 in the mandrel portion 4 and the housing member 21. The passages formed by the clearance between the splines and grooves 56, 59 permit operating fluid to flow between the chamber 52 and the lower portions of the accelerator 1.

Additionally, the arrangement of longitudinally extending splines and grooves 56, 59 in the tubular housing member 21 and on the tubular mandrel portion 4 provides a guide for longitudinal movement of the mandrel 2 in the housing 3 without permitting rotary movement therebetween.

The clearance between the tubular housing member 25 and the mandrel portions 4, 9 is such that there is provided a hydraulic chamber 63 of substantially enlarged size relative to the hydraulic chamber 52. In one embodiment, this enlarged chamber 63 operates as a fluid reservoir for a main operating chamber, described in detail below.

The tubular mandrel portion 9 is provided with a plurality of longitudinally extending grooves 76. The grooves 76 provide flow passages for the flow of operating fluid, as will be subsequently described. A spacer ring 77 is supported on the tubular mandrel portion 9 and has an internal surface 78 spaced from the exterior surface of the mandrel portion 9 to provide an annular flow passage 79.

The spacer ring 77 is provided with apertures 80 which open from the passage 79 into the hydraulic chamber 63. The lower end of the passage 79 also overlaps the upper end of the grooves or passages 76 to provide for continuous fluid communication between the hydraulic chamber 63 and the grooves 76. The upper end of the spacer ring 77 abuts the lower end of the tubular mandrel portion 4. The lower end of the spacer ring 77 is, in turn, abutted by the upper end of a tubular portion 82, which fits over the external surface of the mandrel portion 9 in which the grooves 76 are formed. The tubular portion 82, therefore, encloses the grooves 76 and defines a system of longitudinally extending passages. The lower end of the tubular portion 82 abuts an annular spacer ring 83, which is provided with a plurality of apertures 84 opening into the ends of the grooves or passages 76.

An inner surface 86 of the housing member 29 and an outer surface 87 of the tubular portion 82 are spaced apart to define a hydraulic chamber 88, which is the main operating chamber mentioned above. Generally, the operating fluid within chamber 88 resists relative movement of the mandrel 2 and housing 3. That is, relative movement of the mandrel 2 and housing 3 reduces the volume of the chamber 88, causing a significant increase in the internal pressure of the fluid within chamber 88, thereby producing a force to resist this relative movement. This resistance to relative movement allows a large buildup of static energy. Thus, when the force urging the housing 3 is suddenly removed, as by tripping of the associated drilling jar, the static energy is converted to kinetic energy, causing the mandrel 2 and housing 3 to move rapidly and accelerate a hammer within the associated drilling jar (not shown) to strike an anvil surface with great force. It should be appreciated that this buildup of static energy is accomplished by movement of the mandrel 2 relative to the housing 3 in either longitudinal direction.

Preferably, the operating fluid is selected from a group that is relatively compressible. For example, liquid silicone is preferred because it is substantially more compressible than conventional hydraulic fluid. It should be appreciated that it is the compression of the fluid that stores the energy in the accelerator. Additionally, any of a variety of compressible gases, such as nitrogen gas may also be used as the compressible fluid without departing from the spirit and scope of the instant invention.

Accordingly, means is provided for substantially sealing the chamber 88 to permit this buildup of pressure therein. The surfaces 86, 87 of the chamber 88 are smooth cylindrical surfaces, permitting free movement of a pair of pressure pistons supported therebetween and defining the chamber 88. At the upper end of the hydraulic chamber 88, an annular pressure piston 89 is positioned between the surfaces 86, 87 for sliding movement therebetween. The piston 89 is sealed against fluid leakage by O-rings 90, 91 positioned in annular grooves 92, 93, respectively. Movement of the piston 89 is caused by engagement with the mandrel 2 and, in particular, a shoulder formed by the end of the spacer ring 77. That is, downward movement of the mandrel 2 and spacer ring 77 engages the piston 89 and urges it downward. Alternatively, the lower end of the tubular housing member 25 forms a shoulder that prevents upward movement of the piston 89. Thus, the longitudinal position of the piston 89 is affected by movement of the mandrel 2 in only the downward direction.

In one embodiment, the piston 89 is provided with at least one passage 94 to permit a small leakage flow of operating fluid therethrough. This leakage flow from the chamber 88 to the chamber 63 occurs during thermal expansion of the operating fluid as the accelerator 1 is lowered into the wellbore. However, during jarring, only a very small amount of operating fluid passes through the passage 94.

The lower end of the chamber 88 is similarly sealed by an annular pressure piston 111, which is substantially similar to the piston 89. The piston 111 is sealed against outward flow from the chamber 88 by a conventional one-way check valve 112. Also, the piston 111 is moveable upward by engagement with the annular spacer ring 83 during movement of the mandrel 2 upward and out of the housing 3. The upper end of the tubular housing member **29*a* forms a shoulder that engages the piston 111 and prevents downward movement thereof. The check valve 112 permits the replacement of the very small amount of fluid that leaked through the passage 94 during a previous jarring action. That is, after a jarring action, the pressure in the chamber 110 exceeds that in the chamber 88. Thus, fluid flows from the chamber 110, through the check valve 112, and into the chamber 88, thereby restoring the volume of fluid in the chamber 88** to its pre-jar level.

The mandrel 2 and housing 3 are urged to remain in the central or neutral position illustrated in FIGS. 1A–C by a pair of coil springs 118, 119. A. Alternatively a single coil spring could be used in place of the pair of springs 118, 119. This single spring would extend between the piston 89, 111, and the flanges 120, 121 would be unnecessary. The coil springs 118, 119 are coaxially positioned about the tubular portion 82 within the chamber 88 and respectively extend between the pressure pistons 89, 111 and a pair of radially extending flanges 120, 121. In particular, the flanges 120, 121 form shoulders 122, 123 against which the coil springs 118, 119 rest. The springs 118, 119 also operate to urge the pistons 89, 111 toward the ends of the chamber 88 and to maintain the accelerator 1 in its central or neutral operating position.

A floating piston 109 is positioned in sealing relationship between the mandrel portion 13 and the tubular member 29a to isolate a hydraulically filled chamber 110 from the internal passage 35. The chamber 110 is hydraulically connected to the grooves 76 through the plurality of apertures 84. Thus, the chamber 110 is in hydraulic communication with the chambers 52, 63 to form a substantial fluid reservoir for the operating chamber 88. The floating piston 109 moves longitudinally within the chamber 110 to accommodate pressure changes between the chambers 52, 63, 110 and the internal passage 35. These pressure changes are ordinarily associated with variations in the temperature of the operating environment.

Figure 2A:
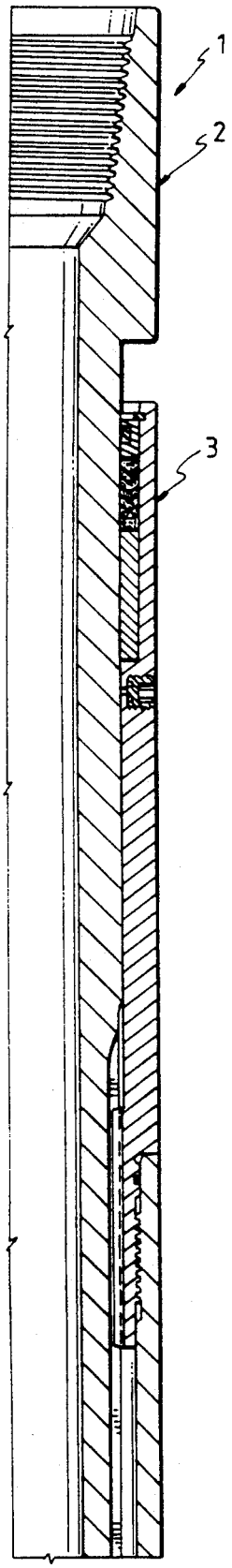
FIGS. 2A–C illustrate successive portions, in quarter section, of the accelerator in its downward operating position.
Figure 2B:
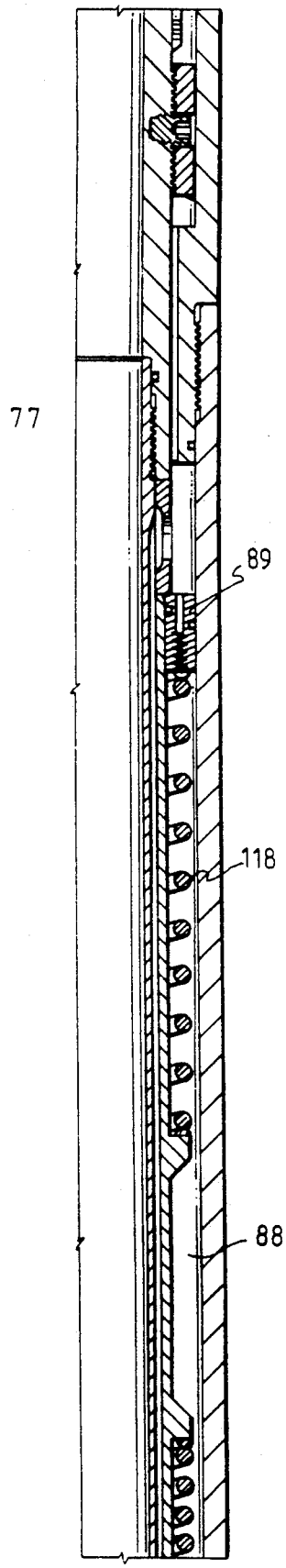
Figure 2C:
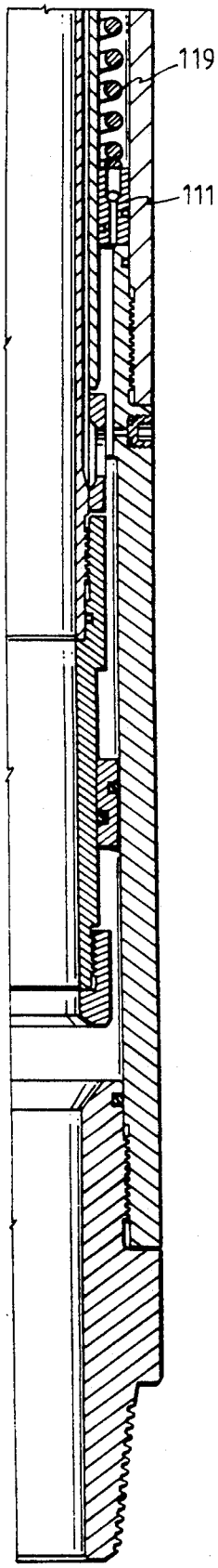

A better appreciation of the operation of the accelerator 1 may be had by reference to FIGS. 2A-C, where a cross sectional view of the accelerator 1 in its downward operating position is shown. The interaction and movement of the various components of the accelerator 1 may best be appreciated by a description of its operation during an actual downward and upward acceleration. Therefore, referring now to FIGS. 2A-C, the movement of the various components of the accelerator 1 during a downward acceleration is illustrated and discussed.

It should be appreciated that a significant operation occurring in the accelerator 1 is the operation and interaction of the pistons 89, 111. Accordingly, the operation of the pistons 89, 111 is discussed in detail in conjunction with the drawings illustrated in FIGS. 2A-C. Further, a description of the accelerator i in its neutral position has already been shown and discussed with respect to FIGS. 1A-C.

The accelerator 1 operates to enhance the hammering action of a drilling jar by storing a large amount of energy therein, which is released in response to the jar being triggered. Accordingly, before a downward jarring action can be initiated, it is first preferable to "arm" the accelerator 1 by placing a portion of the weight of the drill string onto the accelerator 1 and jar. FIGS. 2A-C illustrate the mandrel 2 and, consequently, the spacer ring 77 moved downward relative to the housing 3 and, in particular, to the tubular member 29. This downward movement is, of course, caused by the weight of the drill string resting thereon.

The mandrel 2 has moved sufficiently far downward that the spacer ring 77 has longitudinally moved into the chamber 88, carrying the upper piston 89 therewith. The spacer ring 77 has carried the piston 89 into the chamber 88, thereby compressing the fluid in the chamber 88. The lower piston 111, however, has contacted the upper end of the tubular housing member 29a, preventing further longitudinal movement thereof. It should be appreciated that if a relatively non-compressible hydraulic fluid were to be is used in the chamber 88, then only relatively minor movement would occur.

The coil spring 118 is shown to be relatively uncompressed, owing to the lack of longitudinal movement between the piston 89 and flange 120. The coil spring 119, on the other hand, is highly compressed, owing to the longitudinal movement between the piston 111 and flange 121.

At this point, the accelerator 1 is fully "armed" and prepared to accelerate the hammer of the jar in response to the jar being triggered. In this downward actuation, the mandrel 2 has been forced into the housing 3 by placing the weight of the drill string onto the accelerator 1. When the jar triggers, the support for the housing 3 is removed and the housing 3 is free to move downward with the hammer of the jar. However, the accelerator 1 enhances this downward movement. Since the jar below no longer resists downward movement of the housing 3, then the pressurized fluid in the chamber 88 is free to expand and force the housing 3 downward along with the hammer of the jar. This forced expansion greatly enhances the hammering force of the jar.

Figure 3A:
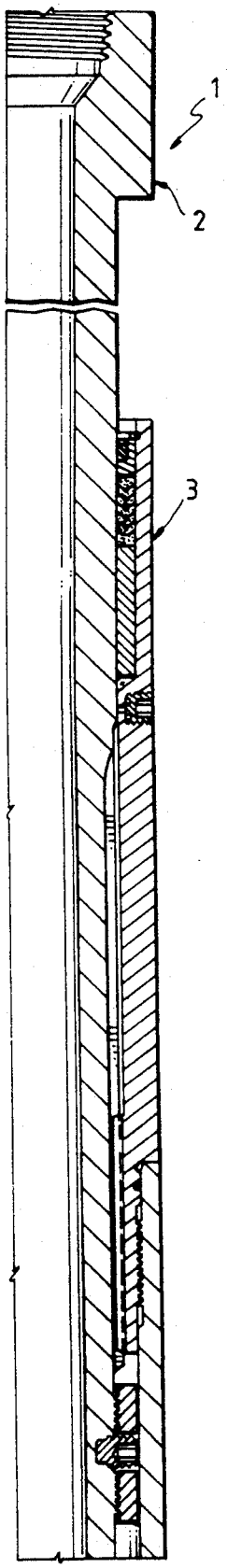
FIGS. 3A–C illustrate successive portions, in quarter section, of the accelerator in its upward operating position.
Figure 3B:
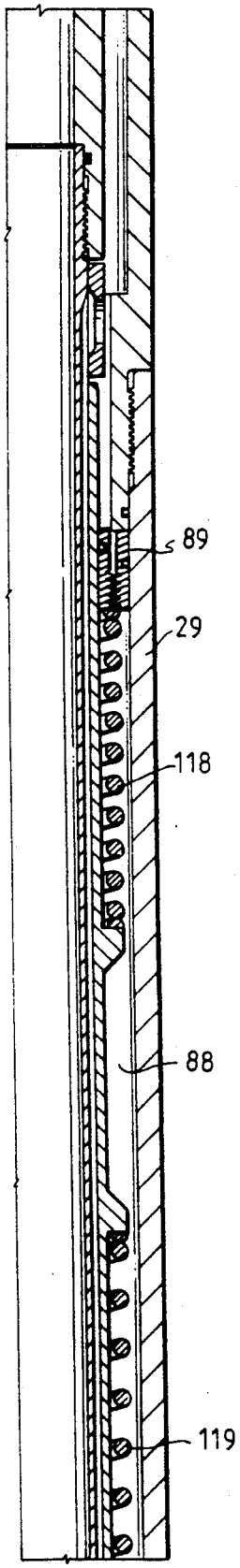
Figure 3C:
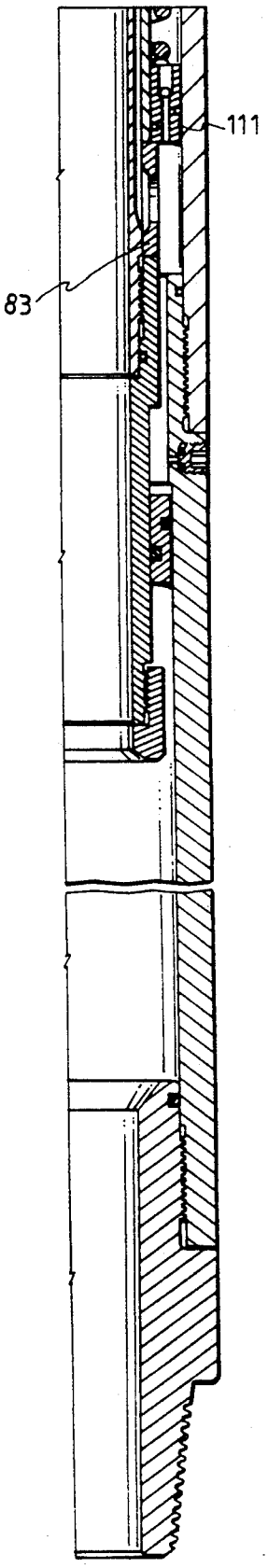

Referring now to FIGS. 3A-C, an upward actuation of the accelerator 1 is described. Once again, the upward actuation is proceeded by the accelerator 1 being positioned in its neutral position, as shown in FIGS. 1A-C. An upward actuation begins by the mandrel 2 being withdrawn or pulled upward and out of the housing 3. Upward movement of the mandrel 2 causes the spacer ring 83 to engage the lower piston 111 and move the piston 111 upward with the mandrel 2.

Movement of the piston 111, of course, reduces the volume of the chamber 88 since the upper piston 89 is prevented from moving upward by engagement with the lower end of the tubular housing member 25. Thus, this movement begins to drastically increase the pressure therein. As discussed previously, a small amount of hydraulic fluid is allowed to leak from the chamber 88 through the upper pressure piston 89, thereby permitting continued gradual movement of the mandrel 2 upward and out of the housing 3.

The coil spring 119 is shown to be relatively uncompressed, owing to the lack of longitudinal movement between the piston 111 and flange 121. The coil spring 118, on the other hand, is highly compressed, owing to the longitudinal movement between the piston 89 and flange 120.

At this point, the accelerator 1 is fully "armed" and prepared to accelerate the hammer of the jar in an upward direction in response to the jar being triggered. In this upward actuation, the mandrel 2 has been forced from the housing 3 by lifting the drill string. When the jar triggers, the housing 3 is no longer held downward by the jar and drill string there below. Thus, the fluid in the chamber 88 is free to expand and pull the hammer of the jar rapidly upward. This forced expansion greatly enhances the upward hammering force of the jar.

In an alternative embodiment of the accelerator 1, the chamber 88 is isolated from the chambers 52, 63, 110 so that a different operating fluid may be employed in the operating chamber 88 from that used in the chambers 52, 63, 110. In the first embodiment described above, the operating fluid used throughout the accelerator 1 is preferably silicone, which tends to have poor lubricating qualities when compared to conventional hydraulic fluid, but is preferable for its greatly enhanced compressibility over that of conventional hydraulic fluid. Therefore in this alternative embodiment of the accelerator 1, the operating chamber 88 is preferably filled with the relatively compressible operating fluid, such as silicone so that the accelerator 1 may store its energy by compressing the silicone. However, the remaining chambers 52, 63, 110 are filled with the relatively incompressible but highly lubricating conventional hydraulic fluid. To prevent mixing of these different fluid types, the upper piston 89 and lower piston 111 are not provided with the passage 94 and check valve 112. Additionally, as discussed above other relatively compressible fluids may be readily substituted for that of silicone, such as, but not limited to, gaseous fluids.

Although a particular detailed embodiment of the apparatus has been described herein, it should be understood that the invention is not restricted to the details of the preferred embodiment, and many changes in design, configuration, and dimensions are possible without departing from the spirit and scope of the invention.

I claim:

1. A double acting accelerator, comprising:

a tubular housing;

a tubular mandrel substantially coaxially arranged for telescoping longitudinal movement within said tubular housing;

a first piston positioned radially between said tubular housing and mandrel, said first piston being adapted for movement with said mandrel in response to movement of said mandrel in a first longitudinal direction relative to said housing and adapted to resist longitudinal movement in response to movement of said mandrel in a second longitudinal direction relative to said housing; and a second piston positioned radially between said tubular housing and mandrel, said first and second pistons forming a substantially sealed chamber therebetween, said second piston being adapted for movement with said mandrel in response to movement of said mandrel in the second longitudinal direction relative to said housing and adapted to resist longitudinal movement in response to movement of said mandrel in the first longitudinal direction relative to said housing, whereby said chamber has an increase in pressure in response to movement of said mandrel in both said first and second longitudinal directions relative to said housing.

2. A double acting accelerator, as set forth in claim 1, including a spring positioned in said chamber and extending longitudinally between the first and second pistons, whereby the first and second pistons are urged away from the longitudinal center of the chamber.

3. A double acting accelerator, as set forth in claim 1, including a fluid reservoir and wherein said first piston defines a restricted passage extending therethrough in fluid communication with said chamber and said reservoir.

4. A double acting accelerator, as set forth in claim 3, wherein said second piston defines a passage extending therethrough in fluid communication with said chamber and said reservoir, and a one-way check valve positioned in said second piston passage and adapted to permit fluid communication in a first direction of flow extending from said reservoir into said chamber.

5. A double acting accelerator, as set forth in claim 1, wherein said mandrel includes a first shoulder formed thereon and adapted for engaging said first piston in response to movement of said mandrel in said first longitudinal direction relative to said housing, and said housing includes a first shoulder formed thereon and adapted for engaging said second piston to resist longitudinal movement of said second piston in response to movement of said mandrel in said first longitudinal direction relative to said housing.

6. A double acting accelerator, as set forth in claim 5, wherein said mandrel includes a second shoulder formed thereon and adapted for engaging said second piston in response to movement of said mandrel in said second longitudinal direction relative to said housing, and said housing includes a second shoulder formed thereon and adapted for engaging said first piston to resist longitudinal movement of said first piston in response to movement of said mandrel in said second longitudinal direction relative to said housing.

7. A double acting accelerator, comprising:

a tubular housing;

a tubular mandrel substantially coaxially arranged for telescoping longitudinal movement within said tubular housing;

a fluid reservoir formed between said tubular housing and mandrel and adapted for receiving an operating fluid therein;

a first piston positioned radially between said tubular housing and mandrel, said first piston being adapted for movement with said mandrel in response to movement of said mandrel in a first longitudinal direction relative to said housing and adapted to resist longitudinal movement in response to movement of said mandrel in a second longitudinal direction relative to said housing; and a second piston positioned radially between said tubular housing and mandrel, said first and second pistons forming a substantially sealed chamber therebetween, said second piston being adapted for movement with said mandrel in response to movement of said mandrel in the second longitudinal direction relative to said housing and adapted to resist longitudinal movement in response to movement of said mandrel in the first longitudinal direction relative to said housing, whereby said chamber has an increase in pressure in response to movement of said mandrel in both said first and second longitudinal directions relative to said housing.

8. A double acting accelerator, as set forth in claim 7, including a spring positioned in said chamber and extending longitudinally between the first and second pistons, whereby the first and second pistons are urged away from the longitudinal center of the chamber.

9. A double acting accelerator, as set forth in claim 7, wherein said second piston defines a passage extending therethrough in fluid communication with said chamber and said reservoir, and a one-way check valve positioned in said second piston passage and adapted to permit fluid communication in a first direction of flow extending from said reservoir into said chamber.

10. A double acting accelerator, as set forth in claim 7, wherein said mandrel includes a first shoulder formed thereon and adapted for engaging said first piston in response to movement of said mandrel in said first longitudinal direction relative to said housing, and said housing includes a first shoulder formed thereon and adapted for engaging said second piston to resist longitudinal movement of said second piston in response to movement of said mandrel in said first longitudinal direction relative to said housing.

11. A double acting accelerator, as set forth in claim 10, wherein said mandrel includes a second shoulder formed thereon and adapted for engaging said second piston in response to movement of said mandrel in said second longitudinal direction relative to said housing, and said housing includes a second shoulder formed thereon and adapted for engaging said first piston t resist longitudinal movement of said first piston in response to movement of said mandrel in said second longitudinal direction relative to said housing.

12. A double acting accelerator, comprising:

a tubular housing;

a tubular mandrel substantially coaxially arranged for telescoping longitudinal movement within said tubular housing in first and second longitudinal directions;

a first piston positioned radially between said tubular housing and mandrel; and a second piston positioned radially between s id tubular housing and mandrel, said first and second pistons forming a substantially sealed chamber therebetween;

a first shoulder formed on said mandrel and adapted for engaging and moving therewith said first piston in response to movement of said mandrel in said first longitudinal direction relative to said housing;

a first shoulder formed on said housing and adapted for engaging said second piston to resist longitudinal movement of said second piston in response to movement of said mandrel in said first longitudinal direction relative to said housing;

a second shoulder formed on said mandrel and adapted for engaging and moving therewith said second piston in response to movement of said mandrel in said second longitudinal direction relative to said housing; and a second shoulder formed on said housing and adapted for engaging said first piston to resist longitudinal movement of said first piston in response to movement of said mandrel in said second longitudinal direction relative said housing.

13. A double acting accelerator, as set forth in claim 12, including a coil spring positioned in said chamber and extending longitudinally between the first and second pistons, whereby the first and second pistons are urged toward the first and second housing shoulders respectively.

14. A double acting accelerator, as set forth in claim 12, including a fluid reservoir and wherein said first piston defines a restricted passage extending therethrough in fluid communication with said chamber and said reservoir.

15. A double acting accelerator, as set forth in claim 14, wherein said second piston defines a passage extending therethrough in fluid communication with said chamber and said reservoir, and a one-way check valve positioned in said second piston passage and adapted to permit fluid communication in a first direction of flow extending from said reservoir into said chamber.

* * * * *

UNITED STATES PATENT AND TRADEMARK OFFICE

CERTIFICATE OF CORRECTION

PATENT NO. : 5,232,060

DATED : AUGUST 3, 1993

INVENTOR(S) : ROBERT W. EVANS

It is certified that error appears in the above-identified patent and that said Letters Patent is hereby corrected as shown below:

Column 10, line 59, "t" should be -- to --.

Column 11, line 3, "s id" should be --said --.

Column 12, line 3, after "relative", insert -- to --.

Column 12, line 5, delete "coil".

Signed and Sealed this

Fifteenth Day of March, 1994

*Attest:*

*Attesting Officer*

Bruce Lehman

BRUCE LEHMAN

*Commissioner of Patents and Trademarks*